United States Patent [19]

Fletcher et al.

[11] 4,168,214

[45] Sep. 18, 1979

[54] GOLD ELECTROPLATING BATH AND METHOD OF MAKING THE SAME

[75] Inventors: Augustus Fletcher, Bristol; William L. Moriarty, South Meriden, both of Conn.

[73] Assignee: American Chemical and Refining Company, Inc., Waterbury, Conn.

[21] Appl. No.: 915,362

[22] Filed: Jun. 14, 1978

[51] Int. Cl.[2] ..... C25D 3/48; C25D 3/62

[52] U.S. Cl. ..... 204/43 G; 204/46 G

[58] Field of Search ..... 204/43 G, 46 G

[56] References Cited

U.S. PATENT DOCUMENTS

| | | | |
|---|---|---|---|
| 2,660,554 | 11/1953 | Ostrow | 204/43 G |
| 2,967,135 | 1/1961 | Ostrow et al. | 204/43 G |
| 3,174,918 | 3/1965 | Rinker et al. | 204/43 G |
| 3,458,542 | 7/1969 | Moore et al. | 260/429 |
| 3,642,589 | 2/1972 | Nobel et al. | 204/44 |

FOREIGN PATENT DOCUMENTS

| | | | |
|---|---|---|---|
| 6917849 | 6/1970 | Netherlands | 204/43 G |
| 445246 | 2/1968 | Switzerland | 204/43 G |
| 1222969 | 2/1971 | United Kingdom . | |

*Primary Examiner*—F. C. Edmundson

[57] ABSTRACT

An aqueous bath for the electroplating of gold is particularly adapted for plating a gold strike on stainless steel and includes about 2 to 16.5 grams per liter of auric(III) gold in a cyanide complex. Potassium nitrate is employed as an electrolyte and ethylenediamine hydrochloride is added as a complexer. Nickel, cobalt, copper, tin, or indium ions may be present as an alloying ingredient for the gold and pH of the bath is not more than 4.0, preferably not more than 1.5. In the method of preparing the bath, an aqueous solution of potassium gold chloride $KAu(Cl)_4$ and potassium nitrate is prepared. Potassium cyanide is added to the solution and reacts with the potassium gold chloride to form a gold cyanide complex. Ethylenediamine hydrochloride is then added to the solution. The ethylenediamine hydrochloride may include nickel chloride or other salts to provide the alloying metal additives for the gold and hydrochloric acid may be added to adjust the pH.

19 Claims, No Drawings

GOLD ELECTROPLATING BATH AND METHOD OF MAKING THE SAME

BACKGROUND OF THE INVENTION

The present invention is concerned with a composition providing an aqueous bath for electrodeposition of gold and gold alloys on a substrate, and with a method of preparing the composition. The invention finds particular application, although it is not necessarily limited thereto, to the provision of an aqueous bath composition for the electrodeposition of a gold or gold alloy strike upon a stainless steel substrate.

Various compositions for electroplating gold or gold alloys are of course known in the art. For example, U.S. Pat. No. 3,598,706 shows a gold cyanide plating bath operable at low pH values. The plating bath employs gold cyanide compounds in which the gold content consists essentially of gold in its plus three valence state i.e., gold (III). A method of using the gold (III) salt employed is described as reacting a gold (III) salt such as auric oxide with an alkali metal cyanide such as potassium or sodium cyanide to form a mixture of the auric and auro (I) gold cyanide compounds. The auric gold species is then separated from the aurous gold species by dissolving the mixture and aging the solution to form an aurocyanide precipitate, which is then separated by filtration. The gold (III) cyanide crystals are obtained from the filtrate by crystallization. A preferred composition is cyanoauric (III) acid, citric acid and diammonium citrate.

U.S. Pat. No. 3,787,463 discloses a gold amine complex useful for electrodeposition of gold and its alloys. The gold amine complex is prepared by adding a polyamine to a solution of a gold (III) salt, for example, gold chloride, and then reacting the mixture with a sulfite containing or producing material and thereafter crystallizing the salt from the solution and recovering it by filtering and purifying by the usual methods. The preferred order of mixing the reactants is as described above; the polyamine may be ethylenediamine.

U.S. Pat. No. 3,458,542 discloses a combination complex of gold with an amine complex of another metal and gold in an aurous cyanide form, to provide a composition for the electrodeposition of the gold. The composition is prepared by dissolving a salt of the other metal in water, adding an amine and then adding an aqueous solution of gold dicyanide. The compound is recovered by precipitation from the solution and filtration.

One difficulty with such prior art compositions and methods is the relative complexity of the method of preparing the compositions which usually involves filtration, precipitation, etc.

Another problem is with which the electroplating art in general is concerned is the necessity for preparing the surface on which an initial layer or strike of metal is to be deposited. In particular, the deposition of an initial gold strike on a stainless steel surface usually requires preliminary pretreatment of the surface to prepare it to accept the gold strike.

It is accordingly an object of the present invention to provide a novel bath composition for an aqueous bath which may be prepared for electroplating a gold and/or gold alloy by a simple and efficient method without the necessity for crystallization, precipitation or filtration.

It is also an object to provide such a novel gold and/or gold alloy electroplating bath composition which is particularly suited to provide an initial strike of gold or gold alloy on an untreated stainless steel surface.

Another object is to provide a novel method for preparing such a composition.

SUMMARY OF THE INVENTION

It has now been found that the foregoing and related objects may be readily attained in an aqueous bath for the electrodeposition of gold, containing at least about 2.0 grams per liter of auric gold and an alkali metal cyanide in an amount of 100–115 percent of stoichiometric amount required to react with the gold to form an alkali metal gold cyanide complex. The combination also includes at least about 3.7 grams per liter of a water-soluble nitrate salt and at least about 13 milliliters per liter of bath of ethylenediamine hydrochloride. The bath solution is substantially free of aurous gold ion and has a pH of not more than about 4.0.

The combination may include sufficient hydrochloric acid to adjust the pH to not more than about 1.5, preferably to between about 0.1 and 1.5. The alkali metal cyanide is preferably present in a stoichiometric amount of 105–110 percent.

The bath may further include up to about 5 grams per liter or 25 percent of the auric gold content, of an alloying metal in the form of a water soluble compound of the metal. The metal is preferably selected from nickel, cobalt, copper, tin, indium and mixtures thereof.

Certain advantages of the invention are attained when the bath contains about 2.0 to 16.5 grams per liter of auric gold, about 3.7 to 75 grams per liter of the soluble nitrate salt and about 13 to 158 milliliters per liter of ethylenediamine hydrochloride, as ethylenediamine. The alloying metal, if present, may be present in the amount of up to 3 grams per liter, as the metal, but not more than 61 mol percent of the gold.

In one aspect of the invention, the gold is provided by a water-soluble alkali metal gold (III) chloride and the alkali metal cyanide is selected from NaCN, KCN, and mixtures thereof. The gold compound is conveniently selected from the class consisting of $AuCl_3$, $HAuCl_4$, $KAuCl_4$, $NaAuCl_4$. The nitrate salt may be selected from the group of alkali metal and alkaline earth metal nitrates, namely $KNO_3$, $LiNO_3$, $NaNO_3$, $Mg(NO_3)_2$, and $Ba(NO_3)_2$.

In accordance with the present invention there is provided a method of preparing an aqueous bath for the electrodeposition of gold including the following steps. A first aqueous solution is prepared by dissolving the following ingredients in water:

(1) a water-soluble auric gold compound in an amount sufficient to provide at least about 2 grams per liter of auric gold in the final bath;

(2) a water-soluble alkali metal cyanide in an amount sufficient to provide at least the stoichiometric amount, but not more than an excess of fifteen percent by weight thereof, required to react with the auric gold to form an alkali metal gold cyanide complex; and (3) a water-soluble nitrate salt in an amount sufficient to provide at least about 3.7 grams per liter of the salt in the final bath.

A second aqueous solution is prepared by adding the following ingredients to water;

(1) ethylenediamine in an amount sufficient to provide about 13 milliliters of ethylenediamine per liter of the final bath; and (2) sufficient HCl to provide at least the stoichiometric amount thereof required to react with the ethylenediamine to form ethylenediamine hydrochloride and to adjust the pH of the bath to not more than about 4.0. The first and second solutions are then mixed to provide the bath, the solutions being mixed in proportions selected to provide the specified quantities of ingredients in the bath.

The method may further include the step of dissolving a water-soluble compound of an alloying metal in the second solution prior to mixing the first and second solutions. The method may further include adding sufficient HCl to adjust the pH to not more than about 1.5.

DETAILED DESCRIPTION OF THE PREFERRED EMBODIMENTS

As indicated above in here, the composition of the present invention comprises a bath including auric gold, an alkali metal cyanide in an amount at least sufficient to form an alkali metal gold cyanide complex with all the auric gold present, a water-soluble nitrate, ethylenediamine, and sufficient HCl, preferably introduced as hydrochloric acid, to provide a pH of not more than about 4 in the bath, preferably not more than about 1.5. Optional additives are metals adapted to alloy with the gold in the electroplate formed from the solution and these may be one or more of nickel, cobalt, copper, tin and indium, which are preferably introduced as the chloride salt of the corresponding metal.

Referring to the auric gold, it may be introduced into the bath as any water-soluble auric gold compound to provide auric gold ion in solution and having an anion which does not interfere with the desired plating properties of the bath. Generally, any water-soluble salt of gold III which does not introduce into the bath elements inimical to gold plating is suitable. However, gold chloride compounds are preferred because, when present in sufficient amount together with nitrate ions, the bath acts as a dilute aqua regia solution with beneficial surface preparation results as described more fully hereinbelow. Among the auric gold compounds suitable for use in accordance with the invention are gold chloride ($AuCl_3$), chloroauric acid ($HAuCl_4$), sodium gold chloride ($NaAuCl_4$), and potassium gold chloride ($KAuCl_4$).

Generally, the auric or gold III ion may be present in any effective amount, i.e., in any amount which will provide a reasonable rate of electrodeposition of the gold from the bath in a coherent, smooth layer. In general, the higher the gold III ion concentration, the greater the efficiency of the electrodeposition up to a concentration of about 1.75 troy ounces of gold per gallon of bath (14.4 grams of gold per liter of bath). Above that concentration, increasing the gold content does not noticeable increase plating efficiency.

The lower limit of gold concentration is generally that which will provide a minimum acceptable plating rate. Generally, a gold concentration of at least one quarter (¼) troy ounce of gold per gallon of bath (at least 2.1 grams of gold per liter of bath) is preferred although, in some cases, a concentration as low as one tenth (1/10) of one troy ounce per gallon (0.8 grams per liter of bath may be employed). A preferred concentration of gold III ion in the bath of the invention for the provision of an initial gold strike layer has been found to be 0.5 troy ounce of gold per gallon of bath (4.1 grams of gold per liter of bath).

At least insofar as plating an initial strike layer of gold (or gold alloy) upon a stainless steel surface is concerned, it is essential for practice of the invention that a gold cyanide complex be formed in solution. If the cyanide complex is not formed, a black, spongy and non-adherent gold deposit will form on an untreated stainless steel substrate. Accordingly, an alkali metal cyanide is provided as a component of the plating bath of the invention in at least an amount sufficient to react with all the auric gold ion provided by the gold salt to form an alkali metal gold cyanide complex. While any alkali metal cyanide may be employed, potassium cyanide and sodium cyanide are preferred as being the most readily available.

One reason for the exclusion of aurous gold ion from the composition is that aurous gold, i.e., gold in the plus 1 oxidation state, reacts at the low pH employed in the bath to form an insoluble precipitate of gold cyanide. On the other hand, cyanide ion and the auric gold ion react to form a soluble complex at a pH of 4 or below, as illustrated by the following equation, which represents the reaction carried out in a solution also containing chloride ion:

$$AuCl_4^- + 4CN^- \rightarrow [Au(CN)_4]^- + 4Cl^-$$

As illustrated by equation (1), the alkali metal cyanide should be included in a mol ratio of 4 mols of alkali metal cyanide, preferably potassium cyanide or sodium cyanide, for each mol of gold III ion. A small excess of the cyanide may be included to assure complete conversion of the gold ion to the cyanide complex ion. However, the cyanide should not be introduced in an amount greater than in excess of about ten percent by weight over the stoichiometric amount needed for complete conversion of the gold III ion to the cyanide complex. Preferably, an excess of about 5 percent by weight is employed. An excess of potassium cyanide or sodium cyanide greater than about 10 percent by weight of the stoichimetric amount has a tendency to reduce at least some of the gold III ion to the gold I oxidation state and, as indicated above, the presence of aurous gold is to be avoided. Accordingly, the amount should not exceed 115 percent of that stoichimetrically required, and preferably not exceed 110 percent. Further, if an alloying metal such as nickel is added to the bath composition in the form of nickel chloride, an excess of free cyanide ion could cause the formation of an insoluble precipitate of nickel cyanide in accordance with the following reaction:

$$NiCl_2 + 2KCN \rightarrow Ni(CN)_2 \downarrow + 2KCl$$

In order to increase the electrical conductivity of the bath composition, there is employed a nitrate salt which is soluble in water and which will not introduce into the bath ions which are inimical to obtaining good gold or gold alloy electroplated deposits. Generally, potassium nitrate is the preferred electrolyte enhancer. However, any other water-soluble nitrate which meets the above criteria may be employed including all of the alkali metal and alkaline earth metal nitrates, namely lithium nitrate, sodium nitrate, magnesium nitrate, and barium nitrate.

An advantage of employing a nitrate electrolyte is that at a relatively low pH of between about 0.1 and 1.5 and in the presence of a sufficient concentration of chloride ion, the bath composition provides, in effect, a dilute solution of aqua regia. It has been found that this aqua regia-like composition beneficially acts upon an otherwise untreated stainless steel substrate to adequately prepare the substrate surface for deposition of an initial gold strike. Thus, the bath composition of the invention enables successful electrodeposition of a gold or gold alloy strike upon an otherwise untreated and uncoated stainless steel substrate which is a significant advantage since it eliminates the need for activating stainless steel surface in a separate preliminary process prior to electroplating the initial gold strike. This advantage is important economically, particularly when plating stainless steel strip or wire on high speed automatic plating machines since the overall speed of the process in not thereby limited to the speed of the pre-treatment step.

Ethylenediamine is also employed in the bath composition to enchance the electrical conductivity of the bath, but also to advantageously provide a means for the introduction and maintainance of a large concentration of chloride ion in the bath. This is accomplished by the reaction between ethylenediamine and hydrochloric acid as illustrated by the following equation:

$$H_2NCH_2CH_2NH_2 + 2HCl \rightarrow {}^{+}H_3NCH_2CH_2NH_3^{+} + 2Cl^{-}$$

wherein ethylenediamine reacts with hydrochloric acid to form ethylenediamine hydrochloride. In aqueous solution at the pH conditions of the bath, dissociation of the ethylenediamine hydrochloride provides a ready source of chloride ions.

The specified amounts of nitrate electrolyte and of hydrochloric acid sufficient to maintain the pH within the specified levels, and the provision of ethylenediamine hydrochloride maintain a level of concentration in the bath of nitrate and chloride ion sufficient to promote self-activation of the stainless steel substrate without the necessity for a pre-treatment step.

The ethylenediamine from which the ethylenediamine hydrochloride is prepared is employed, preferably, in amounts ranging from about 13–160 milliliters per liter of bath solution. Sufficient hydrochloric acid is employed to react with the ethylenediamine and to adjust the pH of the bath to about 0.1 or less when the concentration of ethylenediamine hydrochloride (as ethylenediamine) in the bath is at the lower end of the preferred range, i.e., at about 13 milliliters per liter. If the ethylenediamine content of the bath is at the high end of its preferred range, i.e., from about 100–160 milliliters per liter, the pH may correspondingly be at the higher end of its most preferred range, i.e., between 1.0 to 1.5. In this way, highly satisfactory bright gold deposits may be obtained over a range of current densities as high as 20–30 amperes per square decimeter. If the foregoing ratio of pH to ethylenediamine is not maintained, and the ethylenediamine concentration is high when the pH relatively low, or if it is low when the pH is relatively high as described above, then bright gold electrodeposits are obtained only within a lower and narrower range of current density of up to about 4.5 amperes per square decimeter.

Suitable alloying metals may be included in the bath composition as water-soluble salts and they will be deposited with the gold in selected proportions to provide a selected gold alloy. For reasons stated above, it is preferred to introduce such alloying metals in the form of their chloride salts. Generally, nickel, cobalt, copper, tin and indium are the preferred alloying metals, although other alloying metals such as palladium and other precious metals may be added, and they are preferably added as their corresponding metal chloride salt.

Bath One illustrates a preferred bath composition in accordance with the invention and Bath Two illustrates an alloying bath composition. In each of the examples, the quantity of each component is expressed in terms of its weight per liter of bath solution and it will be understood that the components are dissolved in sufficient water to yield the designated quantities. Ethylenediamine hydrochloride content is expressed in terms of volume of ethylenediamine per volume of bath and hydrochloric acid is expressed in terms of a quantity sufficient to yield the indicated pH.

Bath One

| Component | Quantity |
|---|---|
| Water-soluble gold III, salt (as metal) | 0.25–2.0 troy oz./gal. (2.1–16.4 grams/liter) |
| Water-soluble metal nitrate salt | 0.5–10.0 oz. (Av.)/gal. (3.7–75 grams liter) |
| Alkali metal cyanide | 0.4–3.3oz. (Av.)/gal. (2.7–24.8 grams/liter) |
| Alloying metal salt (as metal) | 0.017–0.35 oz. (Av.)/gal. (0.13–2.64 grams/liter) |
| Ethylenediamine hydrochloride (as enthylenediamine) | 50–600 ml./gal. (13–159 ml./liter) |
| HCl | As needed to adjust pH to not more than 4.0 |

Bath Two

| Component | Quantity |
|---|---|
| Water-soluble gold III salt (as metal) | 1.0 troy oz./gallon (8.2 grams/liter) |
| Water-soluble metal nitrate salt | 4 oz. (Av.)/gallon (30 grams/liter) |
| Alkali metal cyanide | 1.6 oz. (Av.)/gallon 11.9 grams/liter |
| Alloying metal salt (as metal) | 0.17 oz. (Av.)/gallon 1.3 grams/liter |
| Ethylenediamine hydrochloride (as ethylenediamine) | 400 ml./gallon (106 ml./liter) |
| HCl | As needed to adjust pH to not more than 1.5. |

The water soluble gold III salt of Baths One and Two is perferably provided in the form of potassium gold chloride, sodium gold chloride, chloroauric acid or other suitable water-soluble gold III compound as described above, or mixtures of two or more. The water-soluble metal nitrate salt is preferably potassium nitrate or sodium nitrate although other water-soluble nitrates such as lithium nitrate, magnesium nitrate, and barium nitrate (and mixtures thereof) may be employed in either Bath One or Two.

The alloying metal salt of Baths One and Two is preferably a water-soluble nickel salt, preferably nickel chloride. Water-soluble cobalt, copper, tin or indium salts may also be employed, preferably cobalt chloride, copper chloride, tin chloride or indium chloride mixtures of different alloying metals and salts may be employed. For specific examples, nickel sulfateand cobalt sulfate have sucessfully been employed in compositions of the invention.

Most preferably, the componenets of eight Bath One or Bath Two are provided by the following specific ingredients: The auric gold ion is provided by potassium gold chloride, the nitrate salt by potassium nitrate, and the alkali metal cyanide by potassium cyanide, the alloying metal salt by nickel chloride.

It has been found that a specific procedure should be adhered to in preparing the bath compositions of the invention. Generally, a first solution of the water-soluble auric gold compound, the alkali metal cyanide and the water-soluble nitrate salt is prepared. A separate second solution of ethylenediamine, hydrochloric acid and water is prepared in which the ethylenediamine reacts with the hydrochloric acid to form ethylenediamine hydrochloride. The reacted second solution is mixed with the first solution to form the bath composition. If an alloying metal salt is employed, it may be dissolved in the second (ethylenediamine hydrochloric acid) solution prior to mixing the first and second solution, or it may be added directly to the bath solution obtained by mixing the first and second solutions.

An example of the method for preparing the bath composition in accordance with the invention is illustrated in the following Examples.

EXAMPLE ONE

The following materials are placed in a 100 cc. beaker:

0.79 grams of $KAuCl_4$
1.5 grams of $KNO_3$
0.56 grams of KCN
25 cc. of deionized water The mixture is stirred and gently heated to about 65° C. for 15 minutes. No precipitate is visible and a clear solution results. About 0.5 cc. of 50% by weight hydrochloric acid is added to adjust the pH to 1.0, and the solution remains clear.

In a second beaker, 2.0 cc. of ethylenediamine and 9.6 cc. of 50% HCl are mixed and stirred. A slight excess of HCl is added to adjust the pH to 1.0.

The solution from the second beaker is added to the first solution and the volume is adjusted to 50 cc. with deionized water. The resulting bath composition is stable and plates adherent bright gold deposits on an untreated stainless steel.

EXAMPLE TWO

To the bath solution obtained in Example One is added 0.37 cc. of nickel chloride solution (178 grams per liter nickel). The resultant gold alloy bath is stable and plates a bright gold alloy adherent on an untreated stainless steel surface.

EXAMPLE THREE

The following reagents are placed in a 4 liter beaker;

59.7 grams $KAuCl_4$
113.4 grams $KNO_3$
1500 cc. of deionized water

The mixture is stirred until both salts are dissolved in the water to provide a clear solution which has a pH of about 4.0. Then there is added 42.5 grams KCN. A reaction occurs almost immediately at room temperature, and the solution changes from a yellow color to colorless with a small amount of gas being evolved. The reactions taking place are believed to be as follows:

$$KAuCl_4 + 4KCN \rightarrow KAu(CN)_4 + 4KCl$$

The pH of the solution after the addition of the potassium cyanide is about 10.0, and is adjusted to 1.0 by adding 10 cc. of concentrated HCl dissolved in 300 cc. of deionized water.

In a second one liter beaker, there are mixed slowly 150 cc. of ethylenediamine and 300 cc. of distilled water. In a third one liter beaker, are mixed together 360 cc. of hydrochloric acid (50%) and 21.1 cc. of nickel chloride solution (178 grams per liter nickel); and the volume is adjusted to 1 liter with deionized water.

The $HCl/NiCl_2$ solution is slowly added to the ethylenediamine solution, and the solution becomes very hot and the color changes from pale yellow to purple and finally to light green. The following reactions are believed to occur:

$$\underset{\text{pale yellow}}{3H_2NCH_2CH_2NH_2} + \underset{\text{green}}{[Ni(H_2O)_6]^{++}} \rightarrow \underset{\text{purple}}{[Ni(H_2NCH_2CH_2NH_2)_3]^{++}} + 6H_2O$$

$$\underset{\text{pale yellow}}{H_2NCH_2CH_2NH_2} + 2HCl \rightarrow \underset{\text{pale yellow}}{H_3\overset{+}{N}CH_2CH_2\overset{+}{N}H_3} + 2Cl^-$$

$$\underset{\text{purple}}{[Ni(H_2NCH_2CH_2NH_2)_3]^{++}} + 2HCl + 6H_2O \rightarrow \underset{\text{green}}{[Ni(H_2O)_6]^{++}} + \underset{\text{pale yellow}}{H_3\overset{+}{N}CH_2CH_2\overset{+}{N}H_3} + 2Cl^-$$

The pH of the resultant ethylenediamine hydrochloride-$NiCl_2$ solution is about 4.0. The pH of the solution is adjusted to a pH of about 1.0 by adding 5 cc. of concentrated hydrochloric acid.

The ethylenediamine solution is combined with the auric gold solution while the former is still hot from the heat of reaction, and the mixture is stirred. The resulting bath solution is pale green in color, apparently due to the nickel hydrate $[Ni(H_2O)_6{}^{++}]$ ion. The bath volume is adjusted to 1 gallon (3.78 liters) with distilled water. The pH of the bath is 1.45 at this point and 5 cc. of concentrated hydrochloric acid in 25 cc. of distilled water is added to the bath to adjust the pH to about 1.3. An additional 10 cc. of concentrated hydrochloric acid and 50 cc. of deionized water are added to the bath to further adjust the pH to about 1.1.

The resultant bath is stable and no precipitates form in it when it is stored at room temperature for a two-week period.

This bath is tested in 267 milliliter Hull cell having a nickel plated polished brass cathode and a platinized tantalum anode. The solution provides highly satisfactory bright gold alloy strikes on nickel plated brass substrates at current densities of up to 6.7 amperes per square decimeter.

In the course of experimental work leading to the development of the present invention, the unsuitability of aurous gold in the bath composition was clearly demonstrated when attempts to prepare aurous gold solution from potassium (aurous) gold cyanide resulted in baths in which insoluble AuCN precipitated. Be reducing the total aurous gold content to not more than about one-quarter troy ounce aurous gold per gallon of bath, there was obtained a bath which initially was stable and a bright gold plate was deposited. However, the bath slowly turned cloudy after standing for about one and one-half hours and thus was too unstable to be of practical use.

An attempt to make an auric gold bath employing potassium chloride instead of potassium cyanide was unseccessful in that, although the bath was clear and stable, it plated a black, non-adherent gold deposit on the stainless steel substrate and was unsatisfactory for that reason.

Although the invention has been described in detail with reference to the specific preferred embodiments thereof, it will be apparent to those skilled in the art that variations may be made from the described embodiments within the spirit and scope of the invention.

What is claimed is:

1. An aqueous bath for the electrodeposition of gold comprising:

(a) at least about 2.0 grams per liter of auric gold, (b) alkali metal cyanide in an amount of 100–115 percent of the stoichiometric amount required to react with said auric gold to form an alkali metal gold cyanide complex;

(c) at least about 3.7 grams per liter of a water-soluble nitrate salt;

(d) at least about 13 milliliters per liter of bath of ethylenediamine hydrochloride (calculated as ethylenediamine)

said bath being substantially free of aurous gold ion and having a pH of not more than about 4.0.

2. The bath of claim 1 including sufficient hydrochloric acid to adjust the pH to not more than about 1.5.

3. The bath of claim 2 including sufficient hydrochloric acid to adjust the pH to between about 0.1 to 1.5.

4. The bath of claim 1 further including up to about 5 grams per liter of an alloying metal in the form of a water-soluble compound of the metal.

5. The bath of claim 4 wherein said alloying metal ion is selected from the class consisting of nickel, cobalt, copper, tin and indium and mixtures of thereof.

6. The bath of claim 5 containing 0.05–0.61 mols of said alloying metal ion per mol of auric gold.

7. The bath of claim 1 containing about 2.0 to 16.5 grams per liter of said auric gold; about 2.7 to 24.8 grams per liter of said alkali metal cyanide; about 3.7 to 75 grams per liter of said soluble nitrate salt; and about 13 to 158 milliliters per liter of bath of ethylenediamine hydrochloride (calculated as ethylenediamine).

8. The bath of claim 1 wherein said auric gold is provided by a water-soluble alkali metal gold (III) chloride.

9. The bath of claim 1 wherein said alkali metal cyanide is selected from the class consisting of sodium cyanide, potassium cyanide and mixtures thereof.

10. The bath of claim 1 further including hydrochloric acid to maintain the pH at said value of not more than about 4.0.

11. An aqueous bath for the electrodeposition of gold, comprising:

(a) about 2.0 to 16 grams per liter of auric gold ion provided by a gold compound selected from the class consisting of gold chloride, chloroauric acid, potassium gold chloride, and sodium gold chloride, and mixtures thereof;

(b) an alkali metal cyanide selected from the class consisting of potassium cyanide, sodium cyanide, and mixtures thereof, said alkali metal cyanide being present in the ratio of at least four mols of said alkali metal cyanide for each mol of said gold ion but not in excess of about ten percent by weight of the amount necessary to provide said ratio;

(c) about 3.7 to 75 grams per liter of a nitrate salt selected from the class consisting of potassium nitrate, lithium nitrate, sodium nitrate, magnesium nitrate, and barium nitrate, and mixtures thereof;

(d) about 13 to 159 milliliters per liter of ethylenediamine hydrochloride (calculated as ethylenediamine); and (e) hydrochloric acid in an amount sufficient to adjust the pH of said bath to about 0.1 to 1.5.

12. The bath of claim 11 further including a water-soluble chloride salt of a gold alloying metal ion.

13. The bath of claim 12 wherein said chloride salt is selected from the class consisting of nickel chloride, cobalt chloride, copper chloride, tin chloride, and indium chloride.

14. The bath of claim 11 wherein said gold compound is potassium gold chloride, said alkali metal cyanide is potassium cyanide and said nitrate salt is potassium nitrate.

15. In a method of preparing an aqueous bath for the electrodeposition of gold, the steps comprising:

(a) preparing a first aqueous solution by dissolving in water:

(1) a water-soluble auric gold compound in an amount sufficient to provide at least about 2 grams per liter of auric gold in said bath;

(2) a water-soluble alkali metal cyanide in an amount sufficient to provide 100–115 percent of the stoichiometric amount, by weight thereof, required to react with said auric gold to form an alkali metal gold cyanide complex; and (3) a water-soluble nitrate salt in an amount sufficient to provide at least about 3.7 grams per liter of said salt in said bath;

(b) separately preparing a second aqueous solution by dissolving in water:

(1) ethylenediamine in an amount sufficient to provide at least about 13 milliliters of ethylenediamine per liter of said bath; and;

(2) sufficient hydrochloric acid to provide at least the stoichiometric amount thereof required to react with said ethylenediamine to form ethylenediamine hydrochloride and to adjust the pH of said bath to not more than about 4.0; and (c) mixing said first and second solutions to provide said bath, said solutions being mixed in proportions selected to provide the specified quantities of ingredients in said bath.

16. The method of claim 15, including the further step of dissolving a water-soluble compound of an alloying metal in said second solution prior to mixing said first and second solutions.

17. The method of claim 15, wherein said step of dissolving a water-soluble compound of an alloying metal comprises dissolving a chloride salt selected from the class consisting of nickel chloride, cobalt chloride, copper chloride, tin chloride, indium chloride, and mixtures thereof.

18. The method of claim 15 including adding sufficient hydrochloric acid in step (b) (2) to adjust said pH to not more than about 1.5.

19. The method of claim 15 including in step (a) introducing sufficient hydrochloric acid to said first solution to adjust the pH thereof to not more than about 1.5, and including in step (b) adding sufficient hydrochloric acid to said second solution to adjust the pH thereof to not more than about 1.5.

* * * * *